US005421432A

United States Patent [19]

Strambi et al.

[11] Patent Number: 5,421,432

[45] Date of Patent: Jun. 6, 1995

[54] METHOD AND APPARATUS FOR CONTROLLING AND AUTOMATICALLY CORRECTING THE COMMAND FOR DECELERATION/STOPPAGE OF THE CAGE OF A LIFT OR A HOIST IN ACCORDANCE WITH VARIATIONS IN THE OPERATING DATA OF THE SYSTEM

[75] Inventors: Patrizio Strambi, Monvalle; Riccardo Bocconi, Monte S. Pietro, both of Italy

[73] Assignee: Kone Elevator GmbH, Baar, Switzerland

[21] Appl. No.: 95,421

[22] Filed: Jul. 22, 1993

[30] Foreign Application Priority Data

Aug. 5, 1992 [IT] Italy ..... GE92A0086

[51] Int. Cl.[6] ..... B66B 1/36

[52] U.S. Cl. ..... 187/288; 187/291; 187/393

[58] Field of Search ..... 187/116, 118, 112, 113, 187/134, 293, 292, 291, 288, 295, 393

[56] References Cited

U.S. PATENT DOCUMENTS

| | | | |
|---|---|---|---|
| 3,972,389 | 8/1976 | Faup | 187/111 |
| 4,102,436 | 7/1978 | Kernick et al. | 187/291 |
| 4,380,049 | 4/1983 | Mäkinen | 364/426 |
| 4,534,452 | 8/1985 | Ogasawara et al. | 187/29 A |
| 4,683,990 | 8/1987 | Wright | 187/134 |
| 4,700,811 | 10/1987 | Evin | 187/116 |
| 4,775,031 | 10/1988 | Nakamura et al. | 187/111 |
| 4,789,050 | 12/1988 | Evin | 187/134 |
| 4,991,693 | 2/1991 | Stern et al. | 187/111 |
| 5,035,301 | 6/1991 | Skalski | 187/118 |
| 5,099,957 | 3/1992 | Eriksson | 187/111 |
| 5,155,305 | 10/1992 | Horbruegger et al. | 187/119 |
| 5,266,756 | 11/1993 | Hatano | 187/111 |

FOREIGN PATENT DOCUMENTS

| | | |
|---|---|---|
| 382933 | 12/1989 | European Pat. Off. . |
| 2915424 | 4/1979 | Germany . |

OTHER PUBLICATIONS

Database Listing for Finnish F1 66328 patent family information (2 sheets).

International Publication of WO 80/02135-Oct. 16, 1980.

*Primary Examiner*—Steven L. Stephan
*Assistant Examiner*—Robert Nappi

[57] ABSTRACT

A system for adapting the deceleration/stoppage command to the varying momentary speeds of the cage which are due to varying load conditions of the cage itself. The system aso verifies the deceleration/stoppage distance of the cage at certain known speeds, determines the average value of these distances and which, directly or after further processing, compares, this value with a range of known values, outside of which reference data relating to the oblique curve for deceleration/stoppage of the cage is automatically corrected in a proportional manner, the data being known to the electronic processor which governs operation of the system.

8 Claims, 3 Drawing Sheets

METHOD AND APPARATUS FOR CONTROLLING AND AUTOMATICALLY CORRECTING THE COMMAND FOR DECELERATION/STOPPAGE OF THE CAGE OF A LIFT OR A HOIST IN ACCORDANCE WITH VARIATIONS IN THE OPERATING DATA OF THE SYSTEM

DESCRIPTION OF RELATED ART

The invention relates to those systems for lifts and hoists in which, in order to determine the position of the cage in relation to the various floors of the lift shaft, use is made of a perforated strip fixed inside the said lift shaft, parallel to the cage guides, and provided with equidistant perforations which are read by an optoelectronic transducer mounted on board the cage itself and designed also to detect one or more fixed reference elements located at least in the region of one of the end-of-travel stops of the cage. These means form a linear encoder which is combined with an electronic processor which allows the cage travel to be accurately programmed and controlled, dispensing with the traditional installation, inside the lift shaft, of various electrical contacts for deceleration/stoppage, opening/closing of the doors and other operations.

Systems of this type are for example described, inter alia, in the European Patent Publication No. 192513 dated Apr. 1, 1989 and in the corresponding U.S. Pat. No. 4,789,050. These systems are provided with means for detecting the momentary speed of the cage as a function of the load and for modifying this speed during stoppage of the cage so that the transition of the cage itself to the deceleration and stopping means occurs without Jumps in speed and hence with the maximum amount of comfort for the user, and in such a way that the cage itself always stops in the programmed position of alignment with the floor reached in each case.

The technique described in the abovementioned patents is indicated for lifts operated by electric motors powered by thyristors which are driven by a graduator or by other command devices in which the speed of the motor itself may be electronically controlled as a function of the load, so as to be maintained close to, i.e. slightly more or less than, an ideal speed defined as the nominal speed. This technique is therefore not applicable to systems in which deceleration and-stoppage of the cage are effected by operating the motor or other means, for example electromechnical, electrohydraulic, electromagnetic and/or other types of brakes operated in combination with de-energisation of the motor itself, so as to ensure constant deceleration irrespective of the speed.

The said technique described in the abovementioned patents also does not take into consideration the fact that the deceleration supplied by any apparatus designed for this purpose, even if the latter is of a purely electronic nature, and especially so if it is of an electromechanical, electrohydraulic or electromagnetic nature, cannot remain rigidly constant over time since it inevitably varies, albeit in a slow and gradual manner. One need merely consider, for example, the wear which a mechnical brake undergoes with time or the variation in the response of an electrohydraulic brake to variations in the ambient temperature and consequent density of the liquid used.

SUMMARY OF THE INVENTION

For this and other reasons, the objects of the present invention are fulfilled by providing a new method and corresponding system for operating a lift or hoist, provided with a linear or other type of encoder which, in combination with suitable processing means, supplies information on the position and momentary speed of displacement of the cage, and provided with an electronic processor which in combination with the preceding means controls the movement of the cage itself between the various floors of the lift shaft. According to the invention, the processor memory is initially supplied with the data relating to the maximum speed of displacement of the cage and those relating to ascent under zero load and/or descent under full load, and these data are then adopted in the form of reference values. The real speed of displacement of the cage will therefore necessarily be equal to or less than the abovementioned reference values. When the command for starting the known deceleration phase, which would result in the cage stopping correctly at the predetermined floor, is received from the processor, if the cage is moving at the reference speed, the command passes to the lift control logic and becomes effective. If, on the other hand, the real speed of the cage is less than the reference speed, the abovementioned command for starting the deceleration phase and the corresponding oblique deceleration curve are delayed with a speed equal to the real speed and when the curve of the real speed intersects the said oblique deceleration curve at the reference speed, the command for starting the deceleration phase is generated, and is subsequently confirmed by the lift control logic and causes the cage to stop within the required distance so as to be perfectly aligned with the predetermined floor.

Each time the cage moves at one of the speeds programmed in the electronic processor, for example at one of the maximum reference speeds and preferably also at one of the minimum speeds, and at predetermined speeds lying between the maximum and minimum speeds, and each time the control logic confirms a command for starting the cage deceleration/stoppage phase, or each time it should start the deceleration phase according to the programmed speeds, the distance which the cage itself travels until it stops is calculated, the results-are divided up according to speed categories and for each category the average value is determined. The average values of the various speed categories are added together and the average value thereof is again determined and this value is sent to a window comparator which knows the ideal distance value and the plus or minus limits acceptable-for correct stoppage of the cage. If the calculation of the abovementioned distances exceeds the acceptable limits, the window comparator emits a signal which effects proportional correction, in the electronic processor and in the said comparator, of the modified characteristics of the oblique deceleration curve, with the starting point of the said deceleration stoppage phase being brought forward or delayed by the amount required for the cage to stop in the correct position, aligned with the various floors of the lift shaft.

Use of the average value of the stoppage distances or anomalous stoppage distances of the cage and further processing of these values mean that the variations detected with respect to the reference values really indicate a modification of these values and not of exceptional situations due, for example, to use of the lift where the maximum transportable weight is exceeded or to sudden load displacements inside the cage, for which safety devices, which automatically stop the lift itself, are in any case provided.

Objects of the present invention are fulfilled by providing a method and apparatus for controlling and automatically correcting the command for deceleration and stoppage of the cage of a lift or hoise in accordance with variations in the operating data of the system, of the type which comprises a linear or other kind of encoder (6,7) which, in combination with suitable processing means (9, 10, 11, 12, 13, 14, 15, 23, 24, 25, 41), supplied information on the position, the momentary speed of displacement, on the distance travelled and on the direction of displacement of the cage, and provided with an electronic processor (28) which receives from the control logic (16) the data relating to operation of the lift, including the speed and deceleration characteristics, and which in combination with the encoder and the said processing means verifies the movement of the cage itself between the various floors, so that the cage itself always stops in the required alignment with the floor reached in each case, independently of the speed of travel of the cage itself, wherein the electronic processor is supplied with at least the data relating to the maximum speed or speeds of displacement of the cage, for example that during ascent under zero load and that during descent under full load, so that the real speeds of displacement will necessarily be equal to or less than these said programmed speeds, it being provided that when the processor supplies the command for starting the deceleration/stoppage phase which would result in the cage stopping correctly at the predetermined floor, if the cage is moving at the programmed speed, the command passes to the lift control logic and becomes effective, whereas if the real speed of the a cage is less than the programmed speed, the above-mentioned command for starting the deceleration/stoppage phase and the corresponding oblique deceleration curve are delayed with a speed equal to the real speed and when the curve of the real speed intersects the said oblique deceleration curve at the programmed speed, the commend for starting the deceleration phase is generated and will be confirmed by the control logic and will cause the cage to stop within the required distance so as to be perfectly aligned with the predetermined floor.

Objects of the present invention are fulfilled further by the above method, wherein each time the cage moves at a speed equal to or close to one or more significant speeds programmed in the electronic processor, for example at the maximum speed and at the minimum speed, during both its ascent and descent, and preferably also at a certain number of intermediate speeds, and each time the control logic (16) confirms the command for starting the cage deceleration/stoppage phase, or each time it should start the deceleration/stoppage phase according to the data of the programmed speed or speeds, the real distance which the cage itself travels until its stops is calculated and at least the average value of the various values is determined and if the resultant value or the subsequently processed value is greater than or less than a predetermined maximum or minimum value, the reference data relating to the modified characteristic of the oblique curve for deceleration/-stoppage of the cage are automatically modified in the processor, with the starting point of the said deceleration/stoppage phase being brought forward or delayed by the amount required for the cage to stop in the correct position, aligned with the various floors of the lift shaft.

Objects of the present invention are fulfilled further by the above method, wherein the distances travelled by the cage during the deceleration/stoppage phase, along with speeds equal to or close to the speeds programmed in the electronic processor, are processed so as to calculate the average value for each category of speeds and the values resulting from the various categories of speeds are further processed so as to calculate the average value and this datum is compared with a range of known data in order to verify whether these latter data must be corrected or not.

Objects of the present invention are fulfilled by providing an apparatus for control and automatically correcting the command for deceleration/stoppage of the cage of a lift or a hoist in accordance with variations in the operating data of the system, provided with a linear or other kind of encoder (6,7) which generates signals from which it is possible to detect with suitable means (8, 108, 9, 10, 11, 12, 13, 14, 15, 23, 24, 25, 41) the information relating to the direction of travel, the real speed, the distance travelled and the position of the cage inside the lift shaft; comprising a control logic (16) with the data of the system, which governs operation of the system itself and which transmits these data to at least one microprocessor logic (28) with which it is possible to dialogue by means of an input unit (30) and a display (31), and which is provided with a memory unit (32) with the data relating to the position of the cage along the entire lift shaft, order in accordance with a predetermined list and in accordance with the logical sequence of the floors, this apparatus being particularly suitable for implementing the above-mentioned method, the apparatus further comprising a pointer unit (33) connected via its main input to the said memory (32) and via its other inputs to the units (13, 14) which supply information relating to the position of the cage and by which it is kept dynamically aligned with the packet of data obtained from the said memory and relating to two successive floors between which the cage itself is moving or has moved, this data packet being transferred by means of suitable connections (34, 35) into a fast memory unit (36), the output of which is connected to one of the inputs of a comparator (37), the other input of which is connected to the output of the counter (13) which detects the real displacement of the cage; the output of this comparator and the output of said fast memory being connected to respective inputs of a processing unit (38) provided with a further input which receives, from the control logic (16), the information relating to the direction of travel of the cage, and with a further input connected to the unit (41) which calculates the real speed of displacement of the cage itself; this processing unit (38) being provided with a main output connected to the control logic (16) for transferring to the latter the data relating to the devices to be actuated, including the datum relating to the start of the cage deceleration/stoppage phase, and being provided with another output (42) which drives retroactively the said fast memory unit (32) so that, if the comparator (37) does not detect similarity between the input data, the data relating to the deceleration phase are displaced at the real speed of travel of the cage until the condition is achieved where the real speed curve intersects the oblique curve for deceleration at the programmed speed such that, when the comparator (37) detects such a comparability between the input data, it enables the following processing unit (38) to transfer to the control logic the data relating to the devices which must be actuated with reference to the movement of the cage being effected.

Objects of the present invention are fulfilled further by providing the above apparatus, wherein it further comprises a unit (49) for collecting and processing data, which via its inputs is connected:

- to the control logic (16) so as to receive from the latter the datum confirming the start of the cage deceleration phase;
- to the microprocessor logic (28) so as to receive from the latter the programmed data relating to ideal operation of the system at different speeds of displacement of the cage;
- with the output of the counter (13) so as to detect the distance travelled by the cage during ascent or descent, from the moment the deceleration command is received to the moment when the said cage stops;
- with the unit (41) which supplies the data relating to the real speed of displacement of the cage, for comparison with the data supplied by the microprocessor logic, it being provided that, when one of the real speeds is equal to or close to one of the programmed speeds, the unit in question (49) detects the cage stopping distance and repeats this operation over time, associating the values collected, divided up according to various speed categories, with an adder (50) which outputs the average value of the input data, the outputs of the various adders for the different speed categories being connected to a further adder (51) which outputs the average value of the input data and this distance value is compared by a comparator (52) with a known value supplied by a reference block (53), the output of the said comparator being connected to the input of another window comparator (54) connected via this other input to a reference block (55) the parameters of which may be varied as a function of the type and operating characteristics of the lift, this latter comparator being connected with one output (42) to the microprocessor logic (28) so as to activate correction, where required, of the system operating data and being connected with an auxiliary output, via a delaying block (57), to the said reference block (53) which must be kept updated with regard to any modified data.

Further characteristic features of the invention and the advantages arising thereform will emerge more clearly from the following description of a preferred embodiment of the said invention, illustrated purely by way of a non-limiting example.

Figure 1:
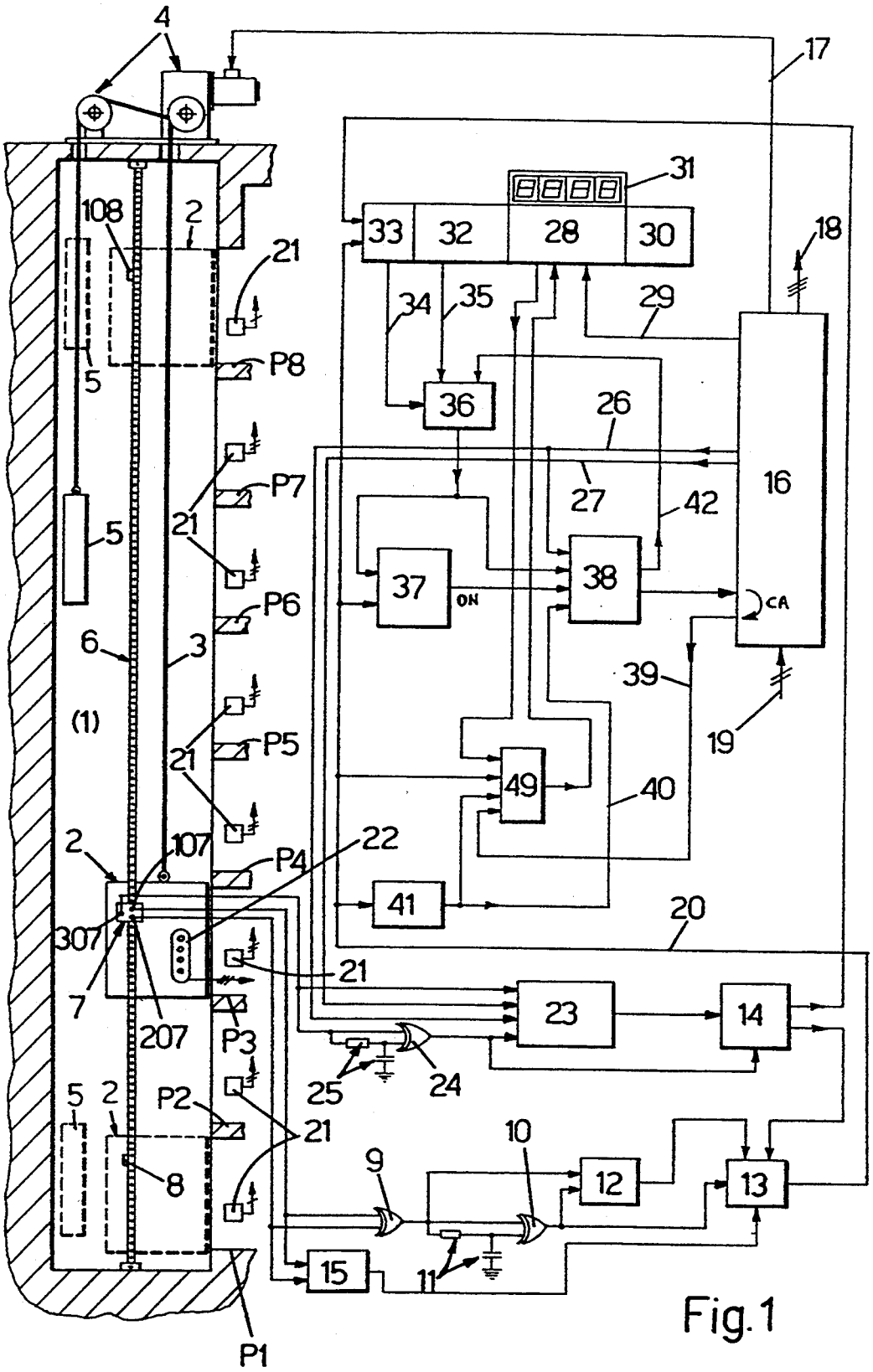
FIG. 1 is a schematic view, in block diagram form, of the lift control system.

In FIG. 1, 1 denotes the lift shaft inside which the cage 2 travels up and down, being connected by means of a cable 3 with actuating and stopping means 4, for example of the electromechanical type. 5 denotes the counterweight for balancing the cage and the load which the latter can transport. It is understood that the method and apparatus in question may be applied to lifts or hoists with a different actuating system, for example of the hydraulic type.

P1, P2, P3, P4, P5, P6, P7 and P8 denote the various floors at which the cage must be able stop correctly.

Figure 2:
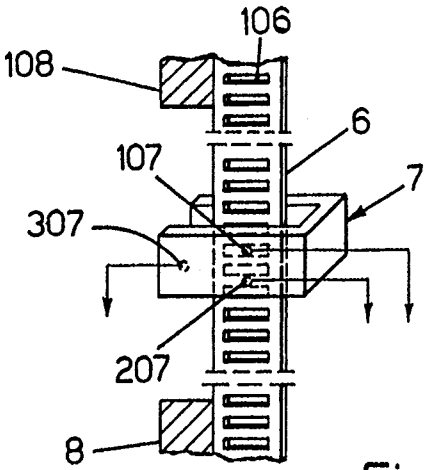
FIG. 2 illustrates, in enlarged form, the linear encoder of known type used in the system in question.

The perforated strip 6 extends and is fixed vertically inside the shaft 1, and is associated for example at its ends, and by means of any intermediate parts, with one of the cage guides (not shown). With reference also to FIG. 2 it may be seen that the strip 6 is provided in a known manner with identical and equidistant perforations 106 which are read by an optoelectronic transducer 7 fixed to the cage 2 and preferably provided with at least two channels 107, 207 for detecting a hole and the adjacent closed part which lies between two successive holes in the strip 6, and provided with a third channel 307 for detecting one or more absolute reference elements located at predetermined points of the said strip 6 or the shaft 1, for example the reference elements indicated by 8, 108, located in the region of the upper and lower end floors P1 and P8 of the lift shaft.

During the movement of the cage 2, the channels 107, 207 of the reader 7 generate square-wave signals, with a phase displacement of ninety degrees relative to each other, which reach the input of a logic gate 9, an exclusive OR, the output of which is directly connected to the input of a second logic gate 10, via a phase-displacement impedance 11, such that at the output of the unit 10 a pulsed signal is present which is high every time one of the two signals from the channels 107, 207 rises and falls.

The outputs of the units 9 and 10 are connected to the input of a test unit 12 which at each count pulse verifies whether the square wave from 9 has changed status. Depending on whether this condition occurs or not, the output of the unit 12 provides an enabling or disenabling signal, respectively, which is sent to one of the inputs of a counter 13 which counts the position of the cage in relation to one of the fixed reference elements 8, 108 from where the count started, for which purpose an input of the same unit 13 is connected to the output of the "position realignment" unit 14 which will be described in more detail below.

Another input of the unit 13 is connected to the output of a unit 15 which determines the counting direction in relation to the ascending and descending movement of the cage. The unit 15 is connected via its input to the channels 107, 207 of the reader 7, is able to distinguish which of the two channels is in advance of the other and hence determine the direction of displacement of the cage 2 and outputs an incremental or decremental command which is sent to the counter 13.

The block 16 represents the normal lift control logic, governing the cage movement, which is connected to the motor/brake group 4 via the branched line 17, which has various outputs 18 for commands of various kinds and which has inputs 19 connected respectively to the call-up push-buttons 21 located at the various floors from P1 to P8 and to the internal push-buttons 22 of the cage 2. The control logic 16 contains some additional functions useful for ascertaining the position of the stop levels of the lift cage, and some of the information available in the said logic 16 is used by the system in question, as described in more detail below.

The block 14 previously considered, which also drives the counter 13, is connected with its inputs to the output of the unit 23 for enabling realignment and to the output of the logic gate 24. The inputs of this gate 24 are connected to the channel 307 of the reader 7, suitably phase-displaced via the impedance 25. When the lift cage reaches the upper and lower end floors P1 and P8, the output of the gate 24 emits pulses useful for the realignment phases.

The unit 23 has connected to its inputs: the output of the gate 24; the channel 307 and the outputs 26, 27 of the control logic 16 relating to the ascent/descent information and to the arrival of the cage at the upper or lower end floor.

The block 28 indicates a microprocessor logic which, via the connection 29, receives the various system data (for example the number of floors, the type of operation, etc.) from the control logic 16. By means of the input unit 30 and the display 31, the operator is able to dialogue with the microprocessor logic 28 using the functions present therein.

32 denotes the permanent memory for the data relating to the position of the cage along the entire shaft, ordered in accordance with a predetermined list. From the logic 28 it receives all the data relating to the position of the cage at the various floors of the lift shaft and the data relating to the devices which must be actuated when the cage itself is about to reach or has reached any one of the various floors, all of which being ordered in accordance with the logical sequence of the floors themselves.

The block 33 represents a pointer unit (in reality there must be at least two pointers to form a window system), driven by the units 13 and 14 from which it receives the information relating to the position of the lift cage and by which it is kept dynamically aligned with the packet of data stored in the list of the unit 32 and relating to two successive floors between which the cage itself is moving or has moved. This data packet is transferred by means of the connections 34, 35 to a following fast memory 36 which is continually updated by the pointer.

From the block 36 the stored data, relating to the two lift floors between which the cage is moving or has moved, are transferred to a comparator 37 which compares it with the data supplied, via the terminal 38, from the output of the counter 13 which detects the real displacement of the cage itself. In the event of there being equivalence between the real-time data supplied by the counter and a stored item of data, the unit 37 outputs an ON command, informs the next block 38 of the equivalence detected and transfers the data relating to the devices which must be actuated depending on the travel movement of the cage, including the datum relating to stoppage of the cage itself.

The data output by the comparator 37 and the data output by the unit 36 reach the unit 38 which also receives at its input, from the terminal 26 of the logic 16, the data relating to the direction of displacement, upwards or downwards, of the cage and which is also connected at one input to the output 40 of the unit 41 which calculates the real speed of displacement of the cage itself. The unit 41 receives the signal from the counter 13, compares it with a distance signal (s) proportional to the distance between two successive holes of the perforated strip 6 and processes it as a function of a time or clock (t), also known, so as to provide the speed datum ($V=s/t$), using a solution which is easily realised by persons skilled in the art and is therefore not described here in detail.

The unit 38 processes the various incoming data and effects variation of the data as a function of-the speed, in accordance with the following logic.

When there is a variation in the load present in the lift cage, the motor/brake group 4, on account of slipping of the electric motor used, which is normally of the asynchronous type, undergoes a variation in speed. In systems in which the speed of the motor is not controlled, as in the case in question, the abovementioned variation in load results in a variation in the distance occurring between the stop command and actual stoppage of the cage. This condition is clearly illustrated in the diagram of FIG. 3 where the ordinates represent the speed of displacement V of the cage and the abscissae represent the distance travelled s. V1 and V2 indicate two different speeds of displacment of the cage, with V1 being greater than V2. Assuming that at the two different speeds the ON command for stoppage of the cage is received simultaneously, it can be noted that, owing to the intrinsic characteristics of the means for slowing down the said cage, which operate with a constant deceleration D (the inclination of the oblique curve section D remains constant), stoppage of the cage itself occurs within different distances which are directly proportional to the speed.

The units 37 and 38 receive, from the list of the unit 32, which contains the stored data relating to operation of the system, i.e. the data set initially by the operator or the data initially automatically ascertained by the system itself (see below), the information relating to the maximum speed of displacement of the cage during the known ascending phase under zero load or descending phase under full load and which we assume to be the speed V1 in FIG. 3. If the cage is actually moving at the speed V1, the comparator 37 detects the equivalence of speed and during formulation of the ON signal (provided by the connection to the counter 13) transfers to the block 38 and then to the control logic 16 the data, supplied from the list of the unit 32, relating to stoppage of the cage and to the devices which must be actuated. If, on the other hand, the cage is moving at the speed V2 and the comparator 37 detects the difference between this speed and the programmed speed V1, the said comparator, during the start of deceleration of the ideal speed V1, supplies the unit 38 with a signal as a result of which the said unit 38, via the output 42, effects the delayed transfer, at the real speed V2, of the data produced by the block 36, until the condition shown in FIG. 4 occurs. It is for this reason that the unit 38 has an input connected to the block 41 which detects the real speed of displacement of the cage. When the comparator 37 detects that the real speed V2 intersects with deceleration of the programmed speed V1, as can be seen from FIG. 4, and outputs the equivalence signal ON, the unit 38 interrupts the function previously activated via the output 42 and transfers to the control logic 16 the data relating to stoppage of the cage and any other devices which must be actuated.

Figure 6:
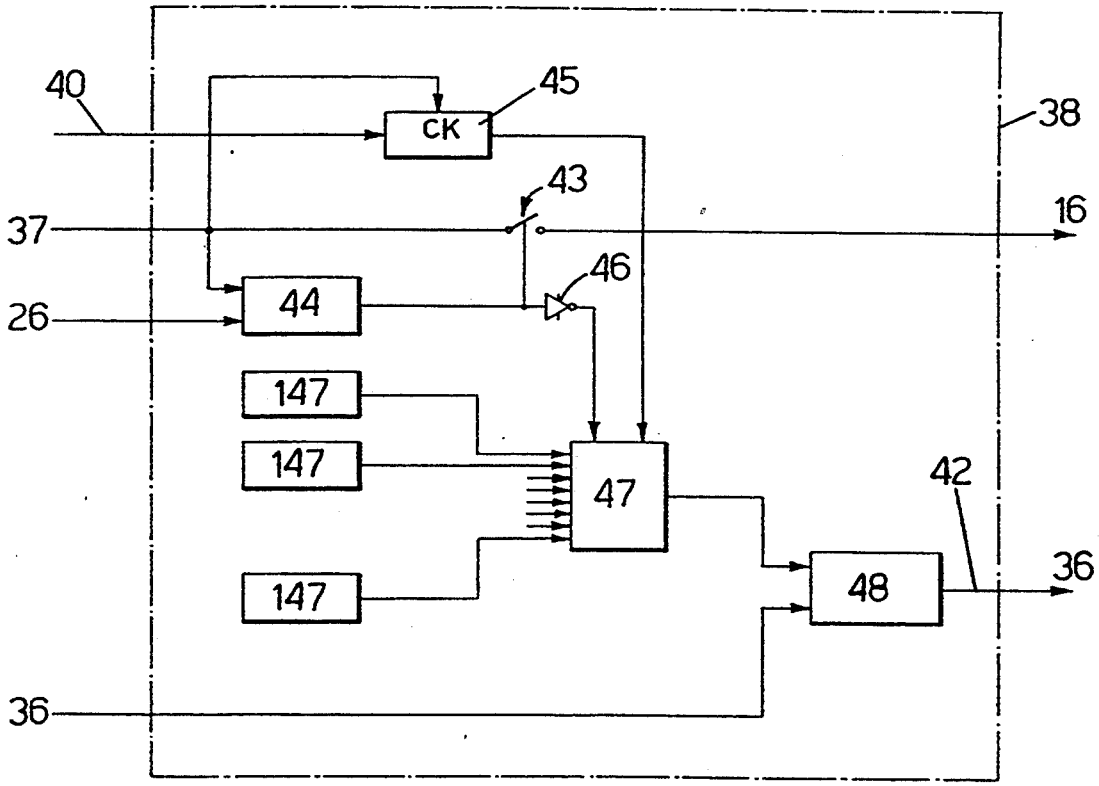
FIG. 6 illustrates a more detailed block diagram relating to the block in FIG. 1 which is responsible for varying the data as a function of the cage speed.

FIG. 6 illustrates a detail of the block 38. The output of the comparator 37 maybe imagined as being a line incorporating a remote control switch 43 which is normally open and driven by the output of the block 44 which verifies whether the datum-relating to the stop command and supplied by the said comparator must be corrected or not. The same block 44 has an input connected to the terminal 26 which supplies the information relating to the ascent or descent of the cage. The cage stop signal relating to the ideal speed loads into a register 45 the real value of the cage travel speed. If the block 44 detects that the datum relating to the stop command must not be corrected, for example because it is correct, or because it has previously already been modified, or because the cage is in a travel phase different from that indicated by the terminal 26, the remote control switch 43 is closed and all the data supplied by the comparator 37 are transferred to the control logic 16. The negator 46 prevents the block connected to it from being affected. If, on the other hand, the datum output by the block 44 must be corrected, the remote control switch 43 remains open and, by means of the multiplexer block 47, the position value supplied by the registers 147 which contain the position data occurring between each floor and the floor immediately after it, is decreased depending on the speed value supplied by the register 45. The value of this decrease is processed in a comparator 48 which receives at its input the position data of the two floors involved in the cage movement and supplied by the block 36, and the output 42 of the comparator returns to this block 36.

Figure 5:
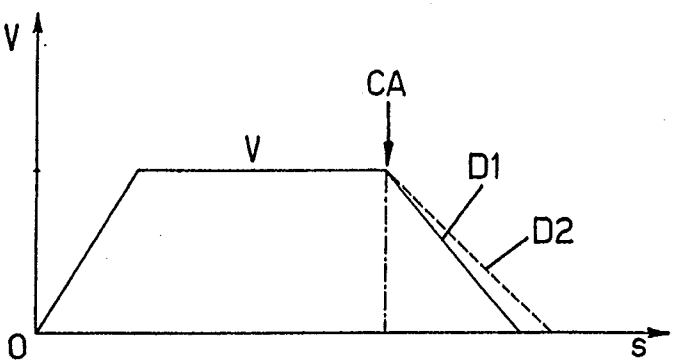
FIG. 5 illustrates the speed/distance diagram which shows the modified response over time of the cage stopping means.

From FIG. 5 it can be noted that the inclination of the oblique curve for deceleration of the cage and hence the distance which the latter travels from the moment the stopping means start to operate until the moment when the actual stoppage point is reached-may vary slowly over time, for example for reasons of wear of the mechnical or hydromechanical braking parts or owing to variations in environmental conditions, for example a variation in the ambient temperature and the effects which this has on the viscosity of the liquid used in hydraulically operated systems. In FIG. 5, D1 indicates the oblique curve for deceleration of the cage as programmed initially in the unit 28, for example corresponding to the performance of the system immediately after installation or maintenance. D2, on the other hand, indicates the oblique curve for deceleration of the cage when the aforementioned anomalous conditions or variables occur. It is clear how, for the same travel speed of the cage, from the moment the confirmation CA is received from the stop command logic 16, the distance required for stoppage of the said cage varies along the abscissae.

Figure 3:
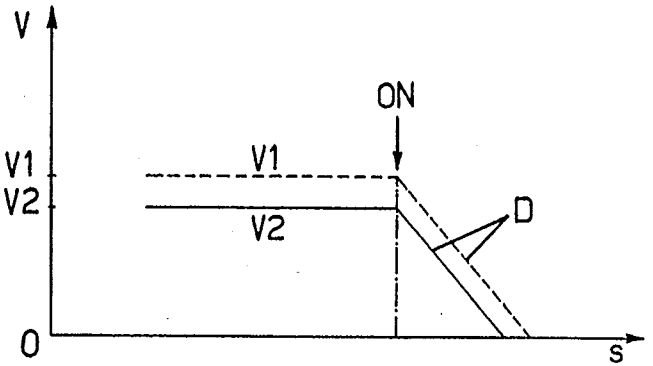
FIGS. 3–4 illustrate speed/distance diagrams relating to movement of the lift cage at different speeds.
Figure 4:
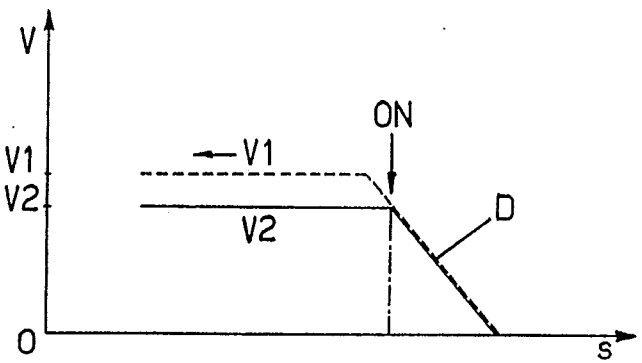

This variation in distance is detected by the data collection unit 49 which, via its inputs, is connected:

- to the terminal 39 of the logic 16 so as to obtain from the latter the confirmation CA of the cage stop command;
- with the microprocessor logic 28 so as to receive from the latter the programmed data relating to ideal operation of the system;
- with the output 20 of the counter 13, so as to detect the distance travelled by the cage during ascent or descent, from the moment the stop command CA or the ideal command ON, referred to in FIGS. 3 and 4, is received to the moment when the said cage stops;
- with the unit 41 which outputs the value of the real speed of displacement of the cage during ascent or descent, for comparison with the data programmed in the microprocessor logic 28.

Figure 7:
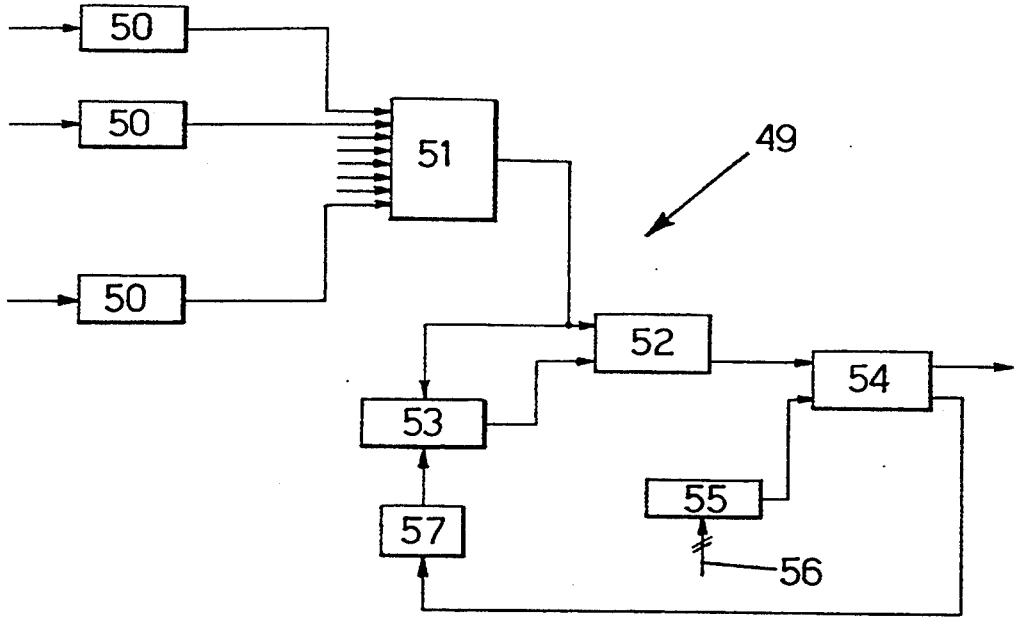
FIG. 7 illustrates a detailed block diagram, relating to a part of the block in FIG. 1 which is responsible for collecting the preceding data and automatically adjusting the lift operating data.

When one of the real displacement speeds of the cage is equal to or close to one of the speeds programmed in the microprocessor logic 28, the unit 49 detects the stopping distance and repeats this operation over time, introducing the value detected into an adder 50, as per the example of FIG. 7. This operation is performed for all the speeds which are equal to or close to those programmed in the microprocessor logic, for each of which there is a corresponding adder 50. The programmed speeds may for example be the maximum speeds and minimum speeds, both during ascent and during descent, and preferably also a predetermined number of intermediate speeds.

The average values of the distances produced by the adders 50 are further added together in 51 and the average value thereof is determined and compared in the next block 52 with a known reference distance supplied by the block 53 and which is the same as that known to the microprocessor logic 28. The output of the block 52 enters a window comparator 54 which receives at its input a reference block 55, the parameters of which may be modified via the corresponding inputs 56, depending on the various system data, for example the type of operation (mechanical or hydraulic), the speed or speeds, etc. If the datum supplied by the block 52 is outside the range of the comparator 54, the latter sends from its output the command to the microprocessor logic 28 to vary all the data of the list concerned. The same information is sent, by means of the delaying block 57, to the reference block 53 which is thus updated.

As a result of this correction, in practice the moment of formulation of the stop command CA referred to in FIG. 5 (and/or the ON command referred to in FIGS. 3 and 4) is suitably delayed (or brought forward if different from that illustrated in FIG. 5; the slope of the oblique deceleration curve D diminishing rather than increasing), so that, in the case of the modified oblique deceleration curve D2, the zero velocity point of this curve coincides with the zero velocity point of the deceleration curve D1, such that, When the cage stops, its bottom is within the necessary tolerance as regards alignment with the floor of the level reached.

The system may be provided with a signalling means, not shown, connected for example to the unit 49 or to the logic 28, for indicating when it is necessary to operate the brake in order to re-establish the best conditions of comfort for use of the lift.

In order to set the system described for operation, first the control logic 16 is supplied with the operating data relating, for example, to the number of stoppages, the speed characteristics, the decelerations during stoppage of the cage, etc., and on the basis of these characteristics the brake of the group 4 will be suitably adjusted. These data are transferred to the unit 28 which is also supplied with the distance and/or time and/or speed data relating to a complete travel movement of the cage from the first to the last floor and/or vice versa or relating to at least one travel movement from one floor to the next floor, and on the basis of all this information the logic 28 prepares the list of data necessary for operation of the system as already considered.

The operator will verify the correctness of the data from the behaviour of the cage during movement between the various floors of the lift shaft and will be able to correct the said data, making use not only of the units 30, 31, but also of a command, not illustrated, which acts on the group 4 so as to effect fine predetermined displacement, upwards or downwards, of the cage. After these checks and corrections, if required, the system is ready for use.

It is understood that the circuits illustrated in block diagram form in the accompanying drawings are merely indicative of the method of operation of the lift and may vary, i.e. the said circuits may be realised in the form of an electronic processor with suitable software instead of using a discrete solution.

It is therefore understood that numerous variations and modifications, in particular of a constructional nature, may be made to the invention, all of which without thereby abandoning the basic principle of the invention, as described above, as illustrated and as claimed below.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for changing adaptively a preset deceleration starting point at which deceleration of an elevator car in an elevator system is started during a present deceleration operation, to bring the car to a stop at a desired point, the method accessing at least a first and second relation in memory, the first relation being of deceleration distance as a function of maximum speed of the car in the upward direction when the car is empty, the second relation being of deceleration distance as a function of maximum speed of the car in the downward direction when the car is loaded to a maximum weight capacity, the method comprising the steps of:

(a) determining instantaneous position of the car;

(b) detecting a speed of the car prior to the car reaching the preset deceleration starting point;

(c) determining a direction of movement of the car as being one of upward or downward, as a function of one of the position and the speed;

(d) selecting one of the first and second relations corresponding to the direction of the car;

(e) measuring at least one aging parameter of the elevator system that changes as components of the elevator system age;

(f) adaptively updating at least one of the relations according to the at least one aging parameter; and (g) adaptively changing the preset deceleration starting point using at least the speed and the corresponding relation during the present deceleration operation.

2. A method as in claim 1, wherein: the first and second relations are linear functions.

3. An elevator control apparatus for changing adaptively a preset deceleration starting point at which deceleration of an elevator car in an elevator system is started during a present deceleration operation, to bring the car to a stop at a desired point, comprising:

a memory for storing at least a first and second relation in memory, the first relation being of deceleration distance as a function of maximum speed of the car in the upward direction when the car is empty, the second relation being of deceleration distance as a function of maximum speed of the car in the downward direction when the car is loaded to a maximum weight capacity;

a car position detector detecting instantaneous position of the car;

a car speed detector;

the car speed being detected by the speed detector prior to the car reaching the preset deceleration starting point;

means, responsive to one of the car speed detector and the position detector, for determining a direction of movement of the car as being one of upward or downward;

at least one aging-parameter sensor, the aging-parameter changing as components of the elevator system age;

a controller, the controller:

selecting one of the first and second relations corresponding to the direction of the car;

updating at least one of the relations according to the at least one aging parameter; and adaptively changing the preset deceleration starting point using at least the speed and the corresponding relation.

4. An apparatus as in claim 3, wherein:

the first and second relations are linear functions.

5. A method as in claim 1, wherein:

the position is detected as a function a beam of light being projected onto a perforated strip having a plurality of perforations, the beam being passed or interrupted by a presence or absence of a perforation in the strip, respectively.

6. An Apparatus as in claim 3, further comprising:

a perforated strip having a plurality of perforations;

wherein the position detector detects car position as a function projecting a beam of light onto the perforated strip, the beam being passed or interrupted by a presence or absence of a perforation in the strip, respectively.

7. A method as in claim 1, further comprising:

determining an average of each aging parameter;

wherein the at least one function is updated as a function of the at least one averaged aging parameter.

8. An apparatus as in claim 3, wherein:

the controller determines an average of each aging parameter; and the controller updates the at least one function as a function of the at least one averaged aging parameter.

* * * * *